US005913593A

United States Patent [19]

Aird et al.

[11] Patent Number: 5,913,593

[45] Date of Patent: Jun. 22, 1999

[54] SKATE BOOT HAVING A MOLDED OUTSOLE WITH RAISED REGIONS

[75] Inventors: Frederic Aird, Ville Mont-Royal; Michel Laferriere, St-Jean, both of Canada

[73] Assignee: Sport Maska Inc., Quebec, Canada

[21] Appl. No.: 08/943,671

[22] Filed: Oct. 3, 1997

Related U.S. Application Data

[63] Continuation of application No. 08/787,304, Jan. 24, 1997, and application No. 29/062,738, Nov. 22, 1996, Pat. No. Des. 390,345.

[51] Int. Cl.[6] ..... A43B 13/14; A43B 5/04; A43B 23/00

[52] U.S. Cl. ..... 36/31; 36/107; 36/115

[58] Field of Search ..... 36/30 R, 31, 131, 36/107, 108, 100, 113, 115, 117.3

[56] References Cited

U.S. PATENT DOCUMENTS

| | | | |
|---|---|---|---|
| D. 390,345 | 2/1998 | Aird et al. | D2/947 |
| 3,526,976 | 9/1970 | Jacobs | 36/100 |
| 3,570,148 | 3/1971 | Morgan . | |
| 4,026,045 | 5/1977 | Druss | 36/108 |
| 4,351,120 | 9/1982 | Dalebout | 36/117.3 |
| 4,353,173 | 10/1982 | Paquet | 36/44 |
| 4,651,445 | 3/1987 | Hannibal | 36/103 |
| 5,052,130 | 10/1991 | Barry et al. | 36/107 |
| 5,131,173 | 7/1992 | Anderié | 36/25 R |
| 5,191,727 | 3/1993 | Barry et al. | 36/107 |
| 5,390,430 | 2/1995 | Fitchmun et al. | 36/30 R |
| 5,404,723 | 4/1995 | Okajima | 36/131 |
| 5,437,466 | 8/1995 | Meibock et al. | 36/115 X |
| 5,657,558 | 8/1997 | Pohu | 36/131 |
| 5,720,117 | 2/1998 | Toschi | 36/76 R |

*Primary Examiner*—B. Dayoan
*Attorney, Agent, or Firm*—Factor and Shaftal

[57] ABSTRACT

An outsole associated with the bottom surface of a boot upper including a base member, front and rear raised regions and a member for attaching the blade chassis to the base member. The base member includes an outer surface, a ball region and a heel region, as well as, a first and a second rigid layer. The second rigid layer overlies a portion of the first rigid layer. The first and second rigid layers extend into the front raised region and the rear raised region.

10 Claims, 2 Drawing Sheets

SKATE BOOT HAVING A MOLDED OUTSOLE WITH RAISED REGIONS

This application is a continuation of Ser. No. 08/787,304 filed Jan. 24, 1997, pending, and a continuation of Ser. No. 29/062,738 filed Nov. 22, 1996 now U.S. Design Pat. No. D390,345.

BACKGROUND OF THE INVENTION

1. Field of the Invention

The present invention is directed to skate boots for ice skating and inline skating, and, more specifically, to skate boots having a molded outsole that extends vertically about regions of the heel and toe, to capture and direct the transfer of energy from the skater to the blade chassis, and, in turn, the skating surface.

2. Background Art

Skate boots of the type attached to blade chassis for use with ice skates or inline skates are well known in the art. Generally, the blade chassis is attached to a rigid base member or sole. The sole is generally of a single planar material which extends from the toe and ball of the boot to the heel of the boot. The upper portion of the skate boot meets the sole and is attached thereto.

Such a construction has certain drawbacks. The skater, while able to transfer energy to the surface through the blade chassis, incurs significant energy losses. The energy from the skaters boot is transferred through the sole to the blade. At the same time, however, some of the energy generated by the skater is lost before it reaches the sole, and, in turn, the blade of the skate. Thus, some energy generated by the skater is not transferred to the blade chassis and the outside surface. The energy losses result in an overall loss of performance which is especially noticeable upon acceleration and turning or otherwise changing direction.

SUMMARY OF THE INVENTION

The skate boot comprises an outsole associated with a bottom of a skate upper, and includes a base member, at least one raised region and means for attaching a blade chassis to at least a portion of the base member. The base member includes an outer surface, a ball region and a heel region. The raised region is associated with at least one of the ball region and the heel region of the base member.

In a preferred embodiment, the raised region comprises a front raised region and a rear raised region. The front raised region is associated with the ball region of the base member. The rear raised region is associated with the heel region of the base member. In such a preferred embodiment, the front raised region may comprise two front raised regions positioned at substantially opposite sides of the ball region of the base member.

Preferably, the rear raised region may extend around the majority of the perimeter of the heel region. Moreover, the rear raised region may extend continuously around the perimeter of the heel region.

In another preferred embodiment, the base member may comprise a first rigid layer and a second rigid layer. The second rigid layer is overlyingly positioned over at least a portion of the first rigid layer. At least one of the first and second rigid layers extending into at least one of the at least one front raised region and the at least one rear raised region.

In such a preferred embodiment, the first rigid layer extends into at least one of the at least one front raised region and the at least one rear raised region.

In another preferred embodiment, the first rigid layer may extend into at least one of the at least one front raised region, and into at least one of the at least one rear raised region.

In yet another preferred embodiment, the first rigid layer may extend into each of the at least one front raised region, and into each of the at least one rear raised region.

Preferably, the second rigid layer may extend into at least one of the at least one front raised regions and at least one rear raised regions.

In another preferred embodiment, the second rigid layer may extend into at least one of the at least one front raised regions and into at least one of the at least one rear raised regions.

In yet another preferred embodiment, the second rigid layer may extend into each of the at least one front raised region and into each of the at least one rear raised region.

DETAILED DESCRIPTION OF THE INVENTION

Figure 1:
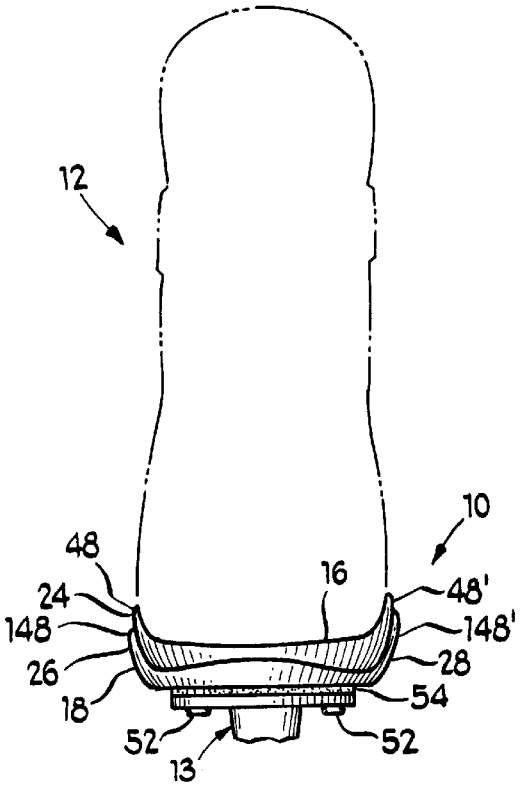
FIG. 1 of the drawings is a front elevational view of the skate boot, showing a partial attachment of the blade chassis.

While the invention is susceptible of embodiment in many different forms, there is shown in the drawings, and will herein be described in detail, one specific embodiment, with the understanding that the present disclosure is to be considered as an exemplification of the principles of the invention and is not intended to limit the invention to the embodiment illustrated.

Figure 5:
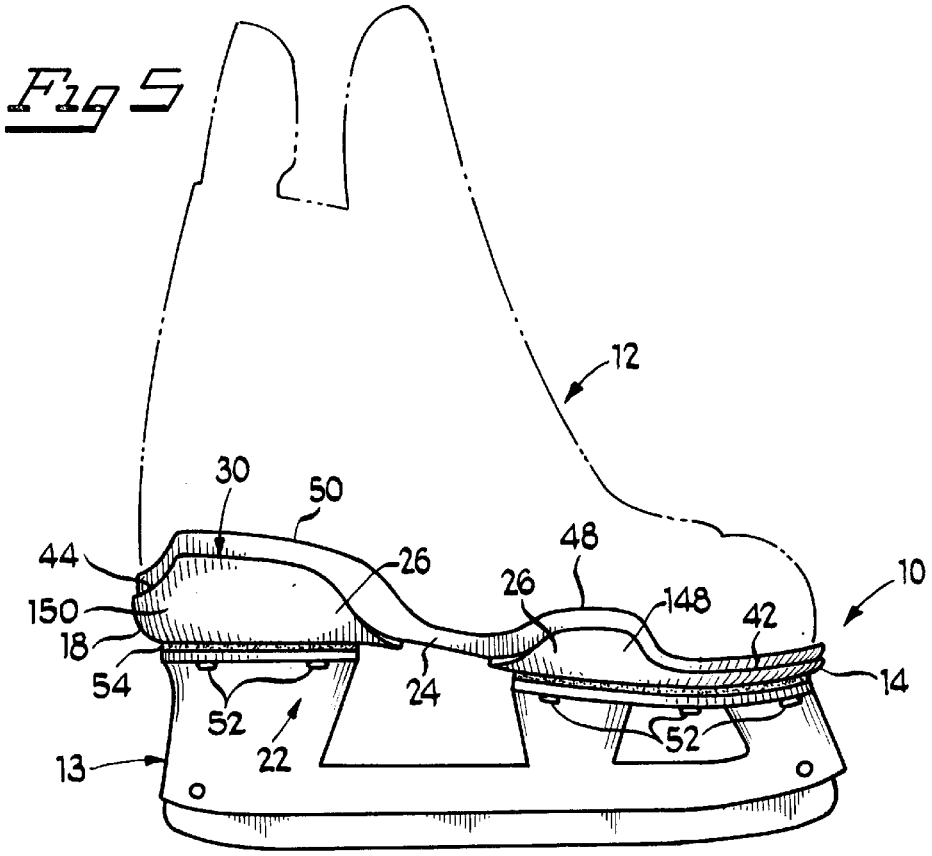
FIG. 5 of the drawings is a right side view of the skate boot, showing the blade chassis.
Figure 6:
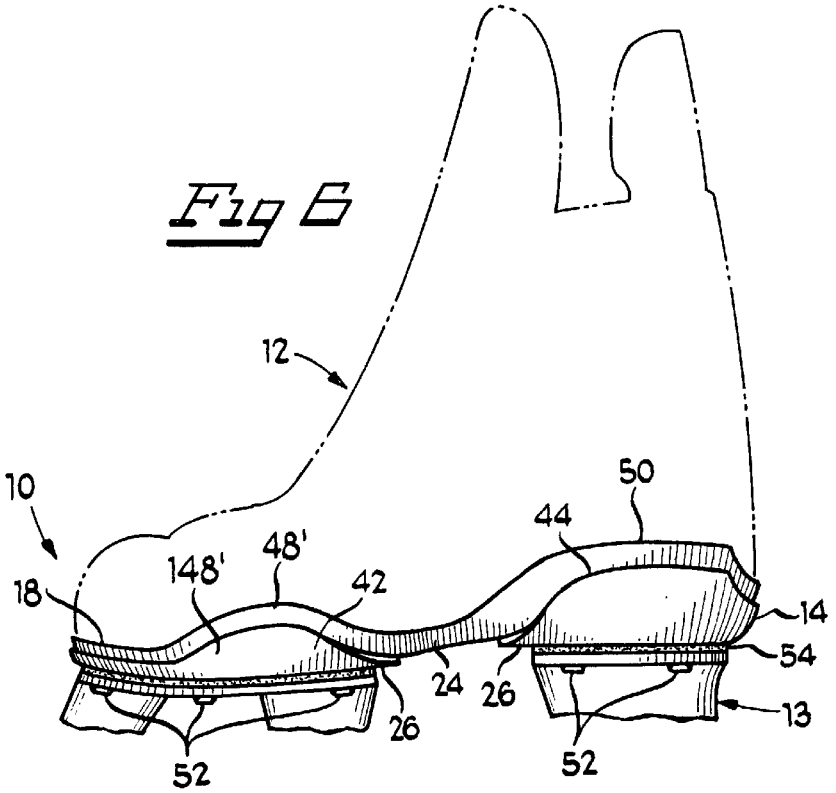
FIG. 6 of the drawings is a left side view of the skate boot, showing a portion of the blade chassis.

Skate boot 10 is shown in FIGS. 1, 2, 5 and 6 as comprising boot uppers 12, blade chassis 13 and outsole 14 (FIG. 5 and FIG. 6). Boot uppers 12 include boot bottom 16 (FIG. 1), and, may comprise a conventional skate boot commonly used for ice skating, ice hockey, street hockey and/or inline skating. Blade chassis 13 (FIG. 5) comprises the carrier for a figure, speed or hockey skate blade as well as, analogously, wheels of an inline skate, or a street hockey skate.

Figure 4:
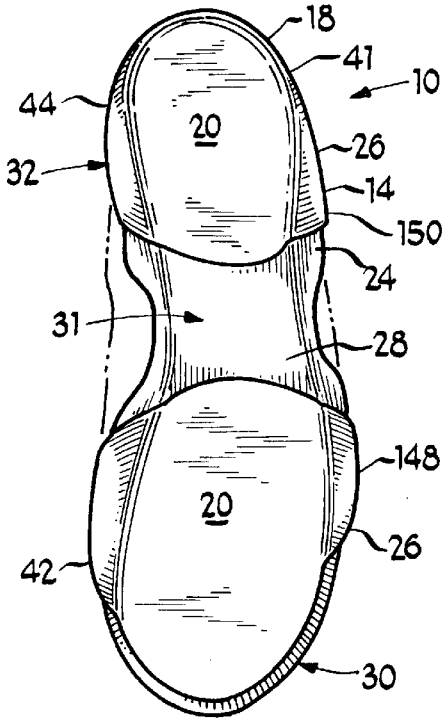
FIG. 4 of the drawings is a bottom plan view of the skate boot, having the blade chassis removed.

Outsole 14 is shown in FIGS. 4, 5 and 6 as comprising base member 18, raised regions 41 and attachment means 22 (FIGS. 5 and 6). Base member 18 comprises first rigid layer 24 and second rigid layer 26, and includes outer surface 28, ball region 30, arch region 31 and heel region 32. First rigid layer 24 (FIGS. 1, 2 and 4–6) extends from ball region 30 to heel region 32.

Second rigid layer 26 is shown in FIGS. 4–6 as comprising proximal second rigid layer 42 and distal second rigid layer 44. Proximal second rigid layer 42 is overlayingly positioned relative to first rigid layer 24 proximate ball region 30, and, extends over substantially the entirety of ball region 30. Distal second rigid layer 44 is similarly overlayingly positioned relative to first rigid layer 24 proximate heel region 32, and, extends over substantially the entirety of heel region 30. It is also contemplated that second rigid layer be positioned over arch region 31.

Raised regions 41 may include front raised regions, such as front raised regions 48, 48', 148, 148', as well as rear raised regions, such as rear raised region 50, 150. Front raised region 48 is an extension of first rigid layer 24 which extends upwardly proximate the outer ball region of the foot. Front raised region 148 is an extension of proximal second rigid layer 42 that overlies front raised region 48. Front raised region 48' is an extension of first rigid layer 24 which extends upwardly proximate the inner ball region of the foot. Front raised region 148' is an extension of proximal second rigid layer 42 that overlies front raised region 48'. As such, the raised regions straddle the ball region and extend upward so as to essentially create a channel for the foot.

Figure 2:
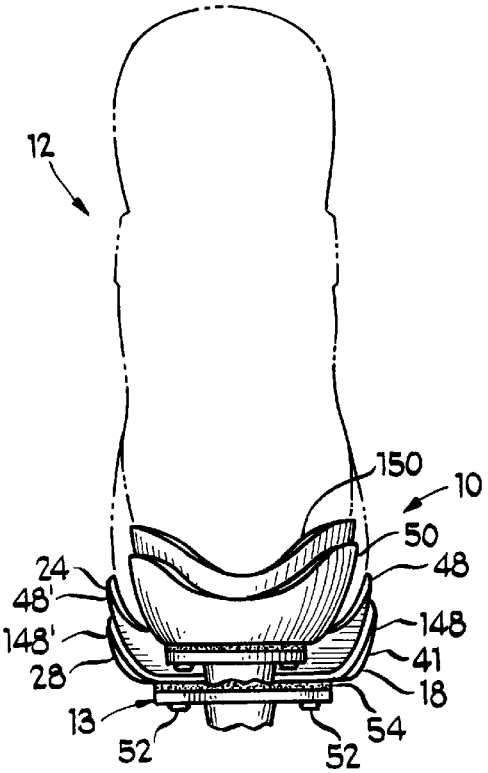
FIG. 2 of the drawings is a rear elevational view of the skate boot, showing a partial attachment of the blade chassis.
Figure 3:
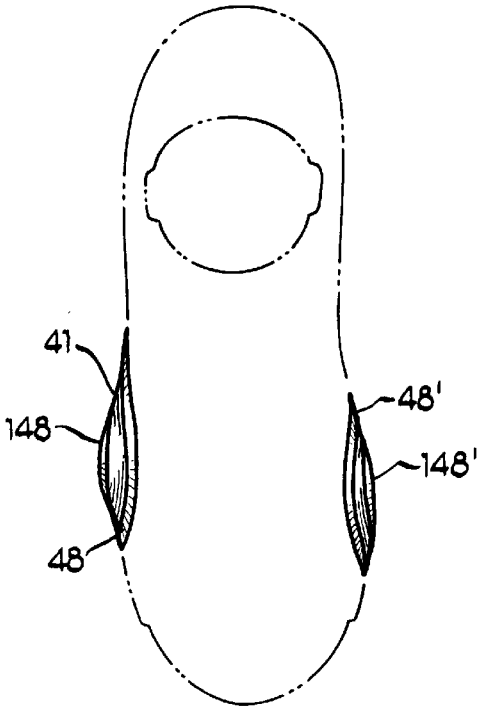
FIG. 3 of the drawings is a top plan view of the skate boot.

Rear raised region 50 is shown in FIGS. 2, 5 and 6 as an extension of first rigid layer which extends upwardly around the perimeter of the heel, essentially from the inside of the heel region to the outside of the heel region. Rear raised region 150 is an extension of distal second rigid layer 44 that overlies rear raised region 50. As such, a cup of the heel region is created. While the rear raised region includes a continuous raised region, it is also contemplated that the heel region may comprise two separate heel regions that straddle the heel region. Vertically, the rear raised regions extend a distance sufficient to effectively straddle or cup the heel.

The addition of raised regions 48, 48', 148, 148', 50 and 150 is valuable to the skater. The raised regions permit greater pressure from the skater's foot to be captured by the larger surface area on the outsole, and, in turn, the pressure/energy is more effectively transmitted to the blade. Indeed, it has been determined that a meaningful additional transfer of energy can be obtained when the raised regions 48, 48' are approximately 1.25 inches and raised region 50 is approximately 1.50 inches at the sides. Empirically, it has been determined that the work transferred by the large raised regions may be in the area of 12–13 times greater than that which is available to the side regions of a conventional sole, or a sole with small raised regions. Such a gain provides noticeable advantages to the skater.

As shown in FIGS. 5 and 6, blade chassis 13 is secured to the base member by attachment means 22, which may comprise a fastener 52 and conventional adhesive 54. Indeed, fastener 52 may comprise a rivet, screw, bolt or other conventional fastening means. In a preferred embodiment, fastener 52 extends through first rigid layer 24 and second rigid layer 26. Of course, other configurations for attachment are also contemplated, such as stitching and the like.

To fabricate base member 18, the material which will comprise second rigid layer 26 is introduced into the molding chamber. Subsequently, the shape of the molding chamber is altered and material which will comprise the first rigid layer 24 is then introduced into the molding chamber. Although not required, an adhesive may be applied between the first and second rigid layers to increase the strength and to promote the bond therebetween. The front and rear raised regions are molded simultaneously with the molding of the first and second rigid layers.

To complete the skate boot, the completed outsole is associated with the bottom of the boot via any combination of adhesive, stitching and/or riveting. The blade chassis is then mounted, through attachment means 22 to the outsole (See FIGS. 5 and 6).

In actual use, and for a better understanding of the benefits of the present invention, a skater wearing the previously described skate will experience more precise control and direct energy transfer between the foot, skate blade chassis and skating surface. As explained above, as a user desires to skate on the ice (or on the street in the case of in-line skates) the additional raised regions (when extending along a substantial vertical distance, as explained above) provide additional area to capture input from the skater and transfer same to the blade (or in-line chassis). Accordingly, the skate becomes more responsive to the input of the skater, and less energy is lost.

The foregoing description and drawings are merely to explain and illustrate the invention and the invention is not limited thereto except insofar as the appended claims are so limited, as those skilled in the art who have the disclosure before them will be able to make modifications and variations therein without departing from the scope of the invention.

What is claimed is:

1. A skate boot comprising:

an outsole associated with a bottom surface of a boot upper;

the outsole including, a base member having an outer surface, a ball region, a heel region, a first rigid layer and a second rigid layer, the second rigid layer overlyingly positioned over at least a portion of the first rigid layer;

at least one front raised region associated with the ball region of the base member;

at least one rear raised region associated with the heel region of the base member; and means for attaching a blade chassis to at least a portion of the base member, wherein at least one of the first rigid layer and the second rigid layer extends into at least one of the at least one front raised region and the at least one rear raised region.

2. The skate boot according to claim 1 wherein the at least one front raised region comprises two front regions positioned at substantially opposite sides of the ball region of the base member.

3. The skate boot according to claim 1 wherein the at least one rear raised region extends around at least a majority of the perimeter of the hell region.

4. The skate according to claim 3 wherein the at least one rear raised region comprises a single continuous raised region.

5. The skate boot according to claim 1 wherein:

the first rigid layer extends into at least one of the at least one front raised region and at least one rear raised region.

6. The skate boot according to claim 1 wherein:

the first rigid layer extends into at least one of the at least one front raised region and into at least one of the at least one rear raised region.

7. The skate boot according to claim 1 wherein the first rigid region extends into each of the at least one front raised regions and into each of the at least one rear region.

8. The skate boot according to claim 1 wherein:

the second rigid layer extends into at least one of the at least one front raised region and at least one rear raised region.

9. The skate boot according to claim 1 wherein:

the second rigid layer extends into at least one of the at least one front raised region and into at least one of the at least one rear raised region.

10. The skate boot according to claim 1 wherein the second rigid region extends into each of the at least one front raised regions and into each of the at least one rear region.

* * * * *